US006919300B2

(12) United States Patent
Dituro et al.

(10) Patent No.: US 6,919,300 B2
(45) Date of Patent: Jul. 19, 2005

(54) PENETRATING LUBRICANT COMPOSITION

(75) Inventors: Michael A. Dituro, Huntington, WV (US); Richard J. Baumgart, Paris, KY (US); Mandeep S. Saini, Lexington, KY (US); Christopher J. Nonevski, Wexford, PA (US)

(73) Assignee: Ashland Inc., Lexington, KY (US)

( * ) Notice: Subject to any disclaimer, the term of this patent is extended or adjusted under 35 U.S.C. 154(b) by 0 days.

(21) Appl. No.: 10/189,301

(22) Filed: Jul. 2, 2002

(65) Prior Publication Data

US 2004/0014613 A1 Jan. 22, 2004

Related U.S. Application Data

(63) Continuation-in-part of application No. 09/607,379, filed on Jun. 30, 2000, now Pat. No. 6,413,916.
(60) Provisional application No. 60/143,856, filed on Jul. 15, 1999.

(51) Int. Cl.[7] ..... C10M 141/12
(52) U.S. Cl. ..... 508/273; 508/275; 508/279; 508/280; 508/282; 508/283; 508/362; 508/365; 508/368; 508/372; 508/373; 508/374; 508/379; 508/385; 508/390; 508/408; 508/413; 508/451; 508/459

(58) Field of Search ..... 508/273, 372, 508/373, 374

(56) References Cited

U.S. PATENT DOCUMENTS 4,107,168 A * 8/1978 Okorodudu ..... 260/302 E
4,416,788 A * 11/1983 Apikos ..... 252/31
5,356,547 A * 10/1994 Arai et al. ..... 252/46.4
6,413,916 B1 * 7/2002 Baumgart et al. ..... 508/273

OTHER PUBLICATIONS

MSDS Sheet for A–31.
MSDS Sheet for A–46.
MSDS Sheet for A–70.
MSDS Sheet for A–108.

* cited by examiner

*Primary Examiner*—Ellen M. McAvoy
(74) *Attorney, Agent, or Firm*—Carrithers Law Office PLLC; David W. Carrithers

(57) ABSTRACT

A protective lubricating composition is provided which will penetrate readily to closely fitting frictional parts and form a protective non-migrating lubricating film improving lubrication between the moving parts reducing friction and wear and preventing corrosion. The lubricant composition may be combined with solvents and propellants to make a sprayable lubricant composition.

62 Claims, No Drawings

PENETRATING LUBRICANT COMPOSITION

This application is a Continuation-In-Part of U.S. patent application Ser. No. 09/607,379 filed on Jun. 30, 2000, now U.S. Pat. No. 6,413,916 B1, which claims priority from U.S. Provisional Application Ser. No. 60/143,856 filed on Jul. 15, 1999 all of which are hereby incorporated by reference.

FIELD OF THE INVENTION

The invention relates to the field of lubricating compositions for penetrating closely fitting frictional parts with the intent of improving lubrication between the parts and forming a protective non-migrating lubricating film for improving lubrication between the moving parts. In addition to reducing friction between moving surfaces, it also provides good penetration between the close fitting surfaces and remains on the lubricated surfaces without migrating or decomposing. The lubricant composition deposits a corrosion protective coating on the surface which prevents corrosion and reduces wear. The lubricant composition can be delivered to the surface in a number of ways such as being combined with solvents and propellants to making a sprayable lubricant composition.

BACKGROUND OF THE INVENTION

Over the years, several oil additives and synthetic lubricants have been developed in order to improve the performance or replace petroleum distillates as lubricants that reduce friction and wear between machinery parts. Lubrication involves the process of friction and wear reduction, accomplished by maintaining a film of a lubricant between surfaces which are moving with respect to each other. The lubricant prevents contact of the moving surfaces, thus greatly lowering the coefficient of friction and reducing wear. In addition to this function, the lubricant also can be called upon to perform heat removal, containment of contaminants, and other important functions. Additives have been developed to establish or enhance various properties of lubricants. Various additives which are used include viscosity improver, detergents, dispersant, extreme pressure additives, corrosion inhibitors, oxidation inhibitors, rust inhibitors, antiwear agents, and detergents have been used to improve the performance and extend the range of uses for petroleum based lubricants.

Synthetic lubricants have been developed for applications wherein petroleum based lubricants are not effective or inexpensively lubricated with conventional lubricants. Silicone oils, have been found especially useful at high temperatures where many petroleum based lubricants would burn off or decompose. However, synthetics such as silicone oil often show poor lubricity in steel-to-steel frictional applications.

Anti-wear agents, many of which function by a process of interactions with the surfaces, provide a chemical film which prevents metal-to-metal contact under high load conditions. Wear inhibitors which are useful under extremely high load conditions are frequently called "extreme pressure agents". Certain of these materials, however, must be used judiciously in certain applications due to their property of accelerating corrosion of metal parts, such as bearings. The instant invention utilizes the synergy between several chemical constituents to provide a penetrating lubricant composition incorporating particular constituents to inhibit the undesirable side effects which may be attributable to use of one of more of the chemical constituents which have valuable lubricating properties when used at particular concentrations and combinations.

The present invention provides a multi-purpose lubricant having high penetration and high lubricity while offering low migration and resistance to corrosion.

SUMMARY OF THE INVENTION

The penetrating lubricant composition of the present invention utilizes a combination of ingredients, comprising a light mineral oil of high purity, a molybdenum based lubricant, a metal sulfonate such as calcium sulfonate, a long chain fatty acids, ZDP, a zinc dithiophosphate derivative and more particularly a zinc alkyldithiophosphate, or other diazole such as a thiadiazole derivative. Some of the fatty acids applicable to the present invention may also be defined as esters which are the reaction product of fatty acids and naturally occurring alcohols. The synergy exhibited between some of the individual components provide superior lubricating capabilities. A masking agent such as vanilla may be added to the composition to provide a pleasant odor. Mineral spirits may be blended with the mineral oil or final composition in an effective amount to add penetrability and control viscosity.

The penetrating lubricant composition of the present invention is prepared by heating an effective amount of a metal sulfonate selected from the group including calcium, barium, and magnesium sulfonate together with long chain fatty acids. The resulting blend is added to a light mineral oil at about 160° F. and mixed together. An effective amount of an organo molybdenum compound, a ZDP, and a corrosion inhibitor such as a alkylthiadiazole are added in order and blended together. The resulting composition contains from about 70 to 90 percent by weight of the light mineral oil, from about 1 to 5 percent by weight of the organo molybdenum compound, from about 10 to about 20 percent by weight of the metal sulfonate, from about 1 to about 5 percent of the long chain fatty acids, from about 0.1 to 3 percent by weight of a ZDP compound and more particularly a zinc alkyldithiophospate compound, and from about 0.01 to 1.0 percent by weight of a diazole corrosion inhibitor. Form 0.001 to about 1.0 percent by weight of a masking agent such as vanilla or a terpene such as limonene may be added to the composition to yield a pleasant odor.

It is an object of the present invention to provide a lubricant composition that provides corrosion resistance.

It is an object of the present invention to provide a penetrating lubricant composition providing a surface film having good friction and wear reduction capabilities when applied to metal surfaces.

It is an object of the present invention to provide a lubricant composition to provide a multi-purpose lubricant which has good penetrating capabilities.

It is an object of the present invention to provide a lubricant composition that forms a protective film.

It is an object of the present invention to provide a lubricant composition applied to metal surfaces by spraying.

It is an object of the present invention to provide a lubricant composition applied by propellant spray, pump spray, aerosol, brushing, or submersion bath.

It is an object of the present invention to provide a lubricant composition utilized in greases, sucker-rod lubricants, cutting fluids, and spray-tube lubricants.

These and other objects of the present invention will be more fully understood from the following description of the invention.

DESCRIPTION OF THE PREFERRED EMBODIMENT

The present invention relates to novel penetrating lubricant compositions and methods of applying such compositions to the metal and other surfaces require protection from corrosion and wear.

The individual components can be separately blended into the base fluid or can be blended therein in various subcombinations. Moreover, the components can be blended in the form of separate solutions in a diluent. It is preferable, however, to blend the selected components used in the penetrating lubricant composition in the form of a concentrate as this simplifies the blending operations, reduces the likelihood of blending errors, and takes advantage of the compatibility and solubility characteristics on the individual constituents.

The penetrating lubricant composition of the present invention is prepared by heating an effective amount of a metal sulfonate selected from the group including calcium, barium, and magnesium sulfonate together with long chain fatty acids at about 140° F. producing a mixture having a paste like consistency. The resulting blend is added to a light mineral oil at about 160° F. and mixed together. Heat is applied to effect homogeneity, until a fluid lubricant products is obtained. An effective amount of an organo molybdenum compound, a ZDP or zinc alkyldithiophosphate, and a corrosion inhibitor such as a diazole are added in order and blended together. The resulting composition contains from about 70 to 90 percent by weight of the light mineral oil, from about 0.1 to 5 percent by weight of the organo molybdenum compound, from about 1.0 to about 20 percent by weight of the metal sulfonate, from about 0.1 to about 5 percent of the long chain fatty acids, from about 0.1 to 3 percent by weight of a ZDP compound, and from about 0.01 to 1.0 percent by weight of a diazole corrosion inhibitor such as 2,5 dimercaptothiadiazole. An effective amount of up to 1.0 percent and more preferably from 0.001 to about 1.0 percent by weight of a masking agent such as vanilla or a terpene such as limonene may be added to the composition to yield a pleasant odor.

Up to 1.0 percent by weight of a masking agent such as vanilla, coconut, or a terpene such as limonene may optionally be added to the composition. It is not necessary that each of these ingredients needs to be present in the composition in the exact amounts in order for the composition to function as a penetrating lubricant; however, the combination promotes optimal performance of the penetrating lubricant composition. The resulting penetrating lubricant may be cut with solvents or propellants to provide a pump or separable lubricant providing good penetration between close fitting parts, good lubricity, corrosion resistance, and resistance to run off or migration from the lubricated area.

The petroleum liquid medium can be any petroleum distillates or synthetic petroleum oils, greases, gels, or oil-soluble polymer composition. More typically, it is the mineral basestocks or synthetic basestocks used in the lube industry, e.g., Group I (solvent refined mineral oils), Group II (hydrocracked mineral oils), Group III (severely hydrocracked oils, sometimes described as synthetic or semi-synthetic oils), Group IV (polyalphaolefins), and Group VI (esters, naphthenes, and others). One preferred group includes the polyalphaolefins, synthetic esters, and polyalkylglycols.

In the preferred embodiment of the present invention, the preferred carrier is a light mineral oil producing a lubricant composition having a viscosity of about 50 SUS viscosity, Saybolt Universal Seconds) when mixed with the other components. An effective amount of mineral oil constitutes a range of up to 99 percent and more preferably from about 10 to 99 percent by weight, more particularly a range or from about 40 to 90 percent by weight, and more particularly from about 60 to 85 percent by weight. The SUS viscosity may vary in accordance with the percent of mineral oil or mineral oil and mineral spirits used therein to provide more penetrability or more film forming characteristics. Mineral spirits which are an odorless solvent may be added to the mineral oil or composite composition to obtain the desired degree and rate of penetration. The mineral oil cut with an effective amount of mineral spirits would preferably yield a penetrating lubricant composition having a viscosity of about 50 SUS viscosity, Saybolt Universal Seconds) when mixed with the other components. Although the method of application may also be dependent upon the SUS viscosity of the resulting composition and whether the lubricant composition is applied by propylene spray, pump spray, brush, or bath. The mineral oil in the preferred embodiment is considered a blend having a viscosity of about 8.3 COT @ 40° C.

The term mineral oil as used herein is meant to cover well know lubricating mineral oils, lubricating oils, and high boiling petroleum distillates with a boiling point range of about 270 to 370° C. The term "mineral spirits" as it is used herein is meant to cover not only the low boiling petroleum fraction (Boiling point range about 150 to about 220° C., known conventionally as mineral spirits in the petroleum refining art, but also "white spirits", "Naphthas", "low boilers", light oils, animal or vegetable oils, and any other combined hydrocarbon solvents or individual normally liquid low molecular weight hydrocarbons having the solvent like properties.

The mineral oil component makes up the major portion of the basic lubricant of the invention. The relative proportions are not critical and will vary with the particular lubricating needs of the user. The mineral oil may be viewed as the carrier oil or the base oil of the composition. The mineral oil is important to provide a means of dispersion of the fatty acids. Mineral spirits also aids in the dispersion of the fatty acids and affects the rate at which the compositions change from a more flowable lubricant to a non-migrating lubricant as the low boiling mineral spirits vaporize in use.

Other mineral oil substrates may be selected from mineral oil base stocks are the 325 Neutral and 100 Neutral, manufactured by Ashland Inc., and by others.

Other acceptable petroleum-base fluid compositions include white mineral, paraffinic and MVI naphthenic oils having the viscosity range of about 20–400 centistoke at 40° C. Preferred white mineral oils include those available from Witco Corporation, Arco Chemical Company, PSI and Penreco. Preferred paraffinic oils include solvent neutral oils available from Exxon Chemical Company, and solvent treated neutral oils available from Arco Chemical Company. Preferred MVI naphthenic oils include solvent extracted coastal pale oils available from Exxon Chemical Company, MVI extracted/acid treated oils available from Shell Chemical Company, and naphthenic oils sold under the names HYDROCAL and CALSOL by Calumet, and described in U.S. Pat. No. 5,348,668 to Oldiges.

A hydrogenated oil is a mineral oil subjected to hydrogennation or hydrocracking under special conditions to remove undesirable chemical compositions and impurities resulting in a base oil having synthetic oil component and properties. Typically the hydrogenated oil is defined by the American Petroleum Institute as a Group III base oil with a sulfur level less than 0.03 with saturates greater than or equal to 90 and a viscosity index of greater than or equal to 120. Most useful are hydrogenated oils having a viscosity of from 2 to 60 COT at 100 degrees centigrade. The hydrogenated oil typically provides superior performance to conventional motor oils with no other synthetic oil base. The hydrogenated oil may be used as the sole base oil component of the instant invention providing superior performance to conventional mineral oil bases oils or used as a blend with mineral oil and/or synthetic oil. An example of such an oil is YUBASE-4.

When used in combination with another conventional synthetic oil such as those containing polyalphaolefins or esters, or when used in combination with a mineral oil, the hydrogenated oil may be present in an amount of up to 90 percent by volume, more preferably from 5.0 to 50 percent by volume and more preferably from 20 to 40 percent by volume when used in combination with a synthetic or mineral oil.

The hydrogenated oil my be used as the sole base oil component of the instant invention providing superior performance to conventional oils with no other synthetic oil base or mineral oil base. A preferred concentrate embodiment may incorporate up to 95 percent by volume, more preferably from 5 to 85 percent by volume when used as the oil base. When used in combination with another conventional synthetic oil such as those containing polyolefins or esters, or when used in combination with a mineral oil, the hydrogenated oil may be present in an amount of up to 95 percent by volume, more preferably from about 10 to 80 percent by volume, more preferably from 20 to 60 percent by volume and most preferably from 10 to 30 percent by volume of the base oil composition.

More particularly, the hydrogenated oil serves as a base oil for a lubricating oil consisting of a mineral oil and/or a synthetic oil, having a viscosity index of at least 110, and having a viscosity of from 2 to 50 COT at 100 degrees C. Hydrogenated oils can be obtained by subjecting raw materials for lubricating oils to hydrogenation treatment, using a hydrogenation catalyst such as cobalt or molybdenum with a silica-alumina carrier, and lubricating oil fractions which can be obtained by the isomerization of waxes. The hydrocracked or wax-isomerized oils contain 90 percent by weight or greater of saturates and 300 p.m. or less of sulfur.

It is contemplated that a 100 percent synthetic oil, a synthetic/mineral oil blend, a synthetic/hydrogenated oil blend, and combinations thereof could be used in the instant invention. Moreover, a vegetable oil could be utilized in place of or in combination with the petroleum oils. For instance, vegetable oil could be used as a carrier and be diluted with an alcohol for particular applications.

The oil soluble molybdenum lubricating compound is available from several manufactures. For instance, Nagase America Corporation produces several organo molybdenum compounds which can be utilized alone or in combination in the present invention including S100, S-165, S-300, S310G. One preferred constituent comprises a molybdenum, bis(2-ethylhexyl)carbamodithioate bis(2-ethylhexyl) at 20% and carbamodithioato oxo thio complexes Bis(2-ethylhexyl) phthalate. It is very important that the molybdenum compound be of a high purity. Other molybdenum compounds deemed useful in the present invention include molybdenum dithiocarbamates (phosphorus free), molybdenum dithiophosphate, molybdenum amine complex, molybdenum phosphate compounds, molybdenum sulfur phosphorus compounds, and combinations thereof.

Other oil soluble molybdenum additives, such as MOLLY 855, manufactured by Vanderbilt Chemical may be substituted for or combined with the above identified organo molybdenum constituents. The MOLLY 855 additive is an oil-soluble decomposable organo molybdenum compound. In general, the organo molybdenum compounds are preferred because of their superior solubility and effectiveness. Exemplary of these is MOLLY L, a dithiophosphomolybdate made by R. T. Vanderbilt Company, Inc., New York, N.Y. USA. MOLLY L is another molybdenum substitute comprising a sulfonated oxymolybdenum dialkyldithiophosphate. MOLLY L contains about 80 wt. % of the sulfide molybdenum dithiophosphate and about 20 wt % of an aromatic oil set forth in the formula given in U.S. Pat. No. 5,055,174 by Howell and hereby incorporated by reference. MOLLY A is also made by Vanderbilt and contains about 28.8 wt. % MO, 31.6 wt. % C, 5.4 wt. % H., and 25.9 wt. % S. Also useful are MOLLY 871, 855, 856, 822, and 807 in decreasing order of preference. Also useful is SAKURA LUBE-500, which is more soluble molybdenum dithiocarbate containing lubricant additive obtained from Asahi Denki Corporation and comprised of about 20.2 wt. % MO, 43.8 wt. % C, 7.4 wt. % H, and 22.4 wt. % S. MOLLY 807, a mixture of about 50 wt. % molybdenum ditridecyldithyocarbonate, and about 50 wt. % of an aromatic oil having a specific gravity of about 38.4 SUS and containing about 4.6 wt. % molybdenum, is also manufactured by R. T. Vanderbilt and marketed as an antioxidant and antiwear additive which may be utilized in the present invention. Other sources are molybdenum $Mo(Co)_6$, and Molybdenum octoate, $MoO(C_7H_{15}CO_2)_2$ containing about 8 weight percent Mo marketed by Aldrich Chemical Company, Milwaukee, Wis. and molybdenum naphthenethioctoate marketed by Shephard Chemical Company, Cincinnati, Ohio. Inorganic molybdenum compounds such as molybdenum sulfide and molybdenum oxide are substantially less preferred than the organic compounds as described. Most preferred are organic thio and phosphor compounds such as those typified by the Vanderbilt and other molybdenum compounds described specifically above.

The preferred dosage in the total lubricant is from about 0.05 to about 15% by weight, more preferably from about 0.5 to about 10% by weight, more preferably from about 1.0 to about 5% by weight and most preferably of from about 2.0 to 4.0% by weight.

A dispersant inhibitor package, ("DI"), containing zinc alkyldithiophosphate (ZDP) also functions as a corrosion inhibitor, antiwear agent, and antioxidants added to organic materials to retard oxidation. Though not narrowly critical, the DI, is exemplified by compounds which contain alkyl zinc dithiophosphates, succinimide, or MANNICH dispersant, calcium, magnesium, sulfonates, sodium sulfonates, phenolic and amine antioxidants, plus various friction modifiers such as sulfurized fatty acids. Dispersant inhibitors are readily available from Lubrizol, Ethyl, Oronite, a division of Chevron Chemical, and Paramains, a division of Exxon Chemical Company. Generally acceptable are those commercial detergent inhibitor packages. Particularly preferred are LUBRIZOL LZ1097. Other ZDP dispersion inhibitors such as LUBRIZOL 8955, ETHYL HITEC 1111 and 1131, and similar formulations available from Paramains, a division of Exxon Chemical, or Oronite, a division of Chevron Chemical may be substituted for the preferred constituent.

It is contemplated that other metal dithiophosphates such as zinc isopropyl, methylamyl dithiophosphate, zinc isopropyl isooctyl dithiophosphate, barium di(nonyl) dithiophosphate, zinc di(cyclohexyl)dithiophosphate, copper di(isobutyl)dithiophosphate, calcium di(hexyl) dithiophosphate, zinc isobutyl isoamyl dithiophosphate, and zinc isopropyl secondary-butyl dithiophosphate may be applicable. These metal salts of phosphorus acid esters are typically prepared by reacting the metal base with the phosphorus acid ester such as set forth in U.S. Pat. No. 5,354,485 hereby incorporated by reference. Moreover, 2,5 dimercaptothiadiazole derivatives are applicable.

Concentration of the ZDP (zinc alkyldithiophosphate) is in the range of from 0.01 to 35.0 percent by weight, more preferably 0.1 to 5.0 percent by weight, and most preferably 0.1 to 2.0 percent by weight of the total composition.

The addition of long chain fatty acids act synergistically with the oil soluble molybdenum lubricating compound, and the dispersant inhibitor package, ("DI"), containing zinc alkyldithiophosphate (ZDP). Lanolin or degras may incorporate the desired long chain fatty acids. Degras is crude wool grease obtained by solvent washing of wool. It is a dark brown semisolid with strong unpleasant odor and high water absorbing capacity. A type known as moellen degras is a by-product of tanning chamois leather with various fish oils. It is available in the form of neutral, common, or technical grades. The degras in the preferred embodiment is a complex mixture of natural fatty acids, alcohols and esters obtained from Corda Canada Ltd or Sealand. Typical physical characteristics of degras include having a specific gravity of about 0.94 to 0.97 at 15° C., it is insoluble in water, having a flash point of 455° F., and is a tenacious, unctuous mass having a slight odor. It is believed that the degras has a long fatty acid chain typical of animal fatty acids and that it is an important constituent for preventing corrosion. It is believed that the degras works synergistically with the ZDP (zinc alkyldithiophosphate) and the oil soluble molybdenum lubricating compound.

Moreover, esters which are reaction products with fatty acids and naturally occurring alcohols may in some cases be substituted for degras or use in combination with degras or each other. For example, lanolin, sperm oil, beeswax, ester waxes, butyl Seagate, ethyl lactate, methyl laureate, methyl oleate, oleyl oleate, methyl palmitate, butyl ricinoleate, methyl stearate, propenyl stearate, butyl ailed, coconut oil, lard oil, palm oil, babassu oil, hydrogenated linseed oil, and other vegetable and fatty oils may utilized in the formulation of the instant invention.

The amount of degras in the penetrating lubricant composition is in the range of from 0.01 to 50.0 percent by weight, more preferably 0.1 to 10.0 percent by weight, and most preferably 1.0 to 5.0 percent by weight of the total composition.

A metal sulfonate, such as a barium, calcium, or magnesium sulfonate is added to the penetrating lubricant composition as a rust preventive from salt spray and to provide acid atmosphere protection having the following formula:

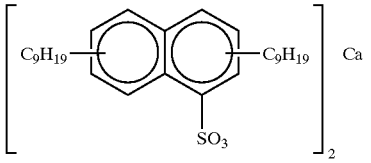

A preferred metal sulfonate corrosion inhibitor is calcium dinonylnaphthalene sulfonate in polyalphaolefin blended with petroleum oxidate ester and organic acids-having a specific gravity of 0.94 at 15.6° C., a melting point of 40° C., flash point of 220° C., and kinematic viscosity at 100° C. of 500 cSt (Saybolt at 100° C. of 2300 SUS). One such corrosion inhibitor is a synergistic blend obtained from King Industries. More particularly the metal sulfonate of the preferred embodiment is a blend containing from about 40 to about 50% of a petroleum oxidate ester, from about 30 to 40% of a calcium dinonylnaphthalene sulfonate, and from about 15 to 25% of a dibasic fatty acid. It is soluble in petroleum and synthetic lubricant bases and most common solvents. It is insoluble in water. When heated above its melting point of 40° C. it rapidly dissolves in petroleum oils which may then be solvent diluted to form stable solutions giving excellent rust protection. In the present penetrating lubricant composition, the metal sulfonate tends to adhere to the surface of the metal substrate providing a means for forming a thicker film and exhibits excellent dispersion without causing migration. The ability to enhance the coating capability of the penetrating composition provides an effective corrosion inhibitor. Another corrosion inhibiting compound is a complex mixture containing calcium sulfonate and zinc compound manufactured by Lockguard Corporation under the 9070 product name.

The amount of the metal sulfonate in the penetrating lubricant composition is in the range of from 0.01 to 90.0 percent by weight, more preferably 1.0 to 50.0 percent by weight, and most preferably from 10.0 to 20.0 percent by weight of the total composition.

A copper deactivating compound, preferably an alkylthiadiazole protects the metal from the free acid produced from the degras and ZDP which tends to attach copper, acting synergistically with same. A preferred copper deactivator is a 2,5-Dimercapto-1,3,4-thiadiazole derivative obtained from R. T. Vanderbilt Company, Inc. And sold under the trademark of CUVAN 826. Other copper deactivators can be utilized with the present invention such as N,N'-disalcylidene-1,2-propanodiamine and alkylthiadiazole, or combinations thereof. Other metal deactivators include benzotriazole, benzotriazole derivatives, benzothiazole, benzothiazole derivatives, triazole, triazole derivatives, dithiocabamate, dithiocarbamate derivatives, imidazole, and imidazole derivatives.

The amount of copper deactivator in the penetrating lubricant composition is in the range of from 0.001 to 10.0 percent by weight, more preferably 0.01 to 2.0 percent by weight, and most preferably from 0.1 to 1.0 percent by weight of the total composition.

A masking agent such as vanilla or other citric scent formed by a terpene in an effective amount ranging from up to 1.0 percent by weight and more preferably from 0.001 to 1.00 percent by weight may be added to the penetrating lubricant composition to mask the odors and provide a pleasant odor.

An example of one preferred embodiment of the penetrating lubricant composition is as follows:

EXAMPLE 1

| | PERCENT BY WEIGHT | | | |
|---|---|---|---|---|
| INGREDIENT | Target | Range | Low Range | High Range |
| Mineral Oil | 78 | 65–90 | 15–80 | 68–74 |
| Organo Molybdenum Compound | 3 | 1–5 | 2 | 4 |
| Calcium Sulfonate Compound | 15 | 10–20 | 12 | 20 |

-continued

| INGREDIENT | PERCENT BY WEIGHT | | | |
|---|---|---|---|---|
| | Target | Range | Low Range | High Range |
| Long Chain Fatty Acid (Degras) | 3 | 1.5–70 | 5.0 | 10 |
| ZDP | 0.5 | .01–2.0 | 0.8 | 0.2 |
| Copper deactivator (2, 5-Dimercapto-1, 3, 4-thiadiazole) | 0.1 | 0.005–0.3 | 0.05 | 0.12 |

EXAMPLE 2

| INGREDIENT | PERCENT BY WEIGHT |
|---|---|
| Mineral Oil | 78 |
| Organo Molybdenum Compound | 3 |
| Calcium Sulfonate Compound | 15 |
| Long Chain Fatty Acid (Degras) | 3 |
| ZDP | 0.5 |
| Copper deactivator (2,5-Dimercapto-1, 3, 4-thiadiazole) | 0.1 |

Optionally a masking agent such as vanilla in an amount ranging from 0.01 to 1.0 percent by weight, and preferably about 0.5 percent by weight may be added to the formula.

The resulting formula exhibited excellent penetrability, friction and wear reduction, film forming ability, and corrosion protection.

A pressurized liquid propellant may be utilized as a carrier to apply the film coating lubricant. One preferred embodiment of the present invention uses a nonfloronated propellant. A commercial liquid hydrocarbon propellant which is compatible with the preferred composition may be selected from the group of A-31, A-46, A-70, or A-108 propane/isobutane blends, with A-46 and A-70 being the most preferred propellant for use with particular compositions. The composition contains an effective amount of propellant. For instance, one embodiment may contain up to 25 weight percent of the propellant, and more preferably from 5 to 20 weight percent of the propellant.

Reference to documents made in the specification is intended to result in such patents or literature being expressly incorporated herein by reference including any patents or other literature references cited within such documents.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

What is claimed is:

1. A penetrating lubricant composition, consisting essentially of an effective amount of:

an oil;

an oil soluble molybdenum lubricating compound;

a metal sulfonate;

a long chain fatty acid;

a metal dithiophosphate; and a copper deactivating compound.

2. The penetrating lubricant composition of claim 1, wherein said oil is present in an amount in the range of up to 99 percent by weight of the total weight of the composition.

3. The penetrating lubricant composition of claim 1, wherein said oil is present in an amount in the range of about 73 to about 83 percent by weight of the total weight of the composition.

4. The penetrating lubricant composition of claim 1, wherein said oil is present in an amount in the range of about 76 to about 80 percent by weight of the total weight of the composition.

5. The penetrating lubricant composition of claim 1, wherein said oil comprises a Group I oil, a Group II oil, a Group III oil, a Group IV oil, a Group VI oil, a polyalkylglycol, a grease, a gel, an oil-soluble polymer composition, a mineral oil, a mineral oil and mineral spirits, a vegetable oil, a vegetable oil and an alcohol, a white mineral oil, a paraffinic oil, a MVI naphthenic oil, a synthetic oil, a synthetic and mineral oil blend, a synthetic and hydrogenated oil blend, a mineral oil and hydrogenated oil blend, and combinations thereof.

6. The penetrating lubricant composition of claim 1, wherein said oil soluble molybdenum lubricating compound is present in an amount in a range of from about 0.05 to 15 percent by weight of the total composition.

7. The penetrating lubricant composition of claim 1, wherein said oil soluble molybdenum lubricating compound is present in an amount in a range of from about 0.1 to 5 percent by weight of the total composition.

8. The penetrating lubricant composition of claim 1, wherein said oil soluble molybdenum lubricating compound is present in an amount in a range of from about 2.0 to 4.0 percent by weight of the total composition.

9. The penetrating lubricant composition of claim 1, wherein said oil soluble molybdenum lubricating compound is present in an amount of up to 3.0 percent by weight of the total composition.

10. The penetrating lubricant composition of claim 1, wherein said oil soluble molybdenum lubricating compound comprises an organo molybdenum.

11. The penetrating lubricant composition of claim 1, wherein said oil soluble molybdenum lubricating compound comprises a molybdenum bis(2-ethylhexyl) carbamodithioate bis(2-ethylhexyl) at 20% and carbamodithioato oxo thio complexes Bis(2-ethylhexyl)phthalate, a molybdenum dithiocarbamnates, a molybdenum amine complex, a molybdenum phosphate compound, a molybdenum sulfur phosphorus compound, an oil-soluble decomposable organo molybdenum compound, a dithiophosphomolybdate, a sulfonated oxymolybdenum dialkyldithiophosphate, a molybdenum compound comprising about 80 wt. % of a sulfide molybdenum di-thiophosphate and about 20 wt % of an aromatic oil, a soluble molybdenum dithiocarbate containing lubricant additive comprising of about 20.2 wt. % molybdenum and 43.8 wt. % carbon and 7.4 wt. % hydrogen, and 22.4 wt. % sulfur, a mixture of about 50 wt. % molybdenum ditridecyldithyocarbonate and about 50 wt. % of an aromatic oil having a specific gravity of about 38.4 SUS and containing about 4.6 wt. % molybdenum, molybdenum $Mo(Co)_6$, molybdenum octoate $MoO(C_7H_{15}CO_2)_2$, molybdenum naphthenethioctoate, molybdenum sulfide, and molybdenum oxide.

12. The penetrating lubricant composition of claim 1, wherein said metal sulfonate is present in an amount in a range of from about 0.05 to 50 percent by weight of the total composition.

13. The penetrating lubricant composition of claim 1, wherein said metal sulfonate is present in an amount in a range of from about 0.01 to 20.0 percent by weight of the total composition.

14. The penetrating lubricant composition of claim 1, wherein said metal sulfonate is present in an amount in a range of from about 1 to 20 percent by weight of the total composition.

15. The penetrating lubricant composition of claim 1, wherein said metal sulfonate is present in an amount in a range of from about 10 to 20 percent by weight of the total composition.

16. The penetrating lubricant composition of claim 1, wherein said metal sulfonate is present in an amount of about 15 percent by weight of the total composition.

17. The penetrating lubricant composition of claim 1, wherein said metal sulfonate comprises calcium sulfonate.

18. The penetrating lubricant composition of claim 1, wherein said metal sulfonate comprises calcium sulfonate, barium sulfonate, magnesium sulfonate and combinations thereof.

19. The penetrating lubricant composition of claim 1, wherein said metal sulfonate comprises calcium dinonylnaphthalene sulfonate in a polyalphaolefin blended with a petroleum oxidate ester and organic acids having a specific gravity of 0.94 at 15.6° C., a melting point of 40° C., flash point of 220° C., and kinematic viscosity at 100° C. of 500 cSt.

20. The penetrating lubricant composition of claim 1, wherein said metal sulfonate comprises a blend containing from about 40 to about 50% of a petroleum oxidate ester, from about 30 to 40% of a dinonylnaphthalene sulfonate, and from about 15 to 25% of a dibasic fatty acid.

21. The penetrating lubricant composition of claim 1, wherein said metal sulfonate comprises a blend containing from about 40 to about 50% of a petroleum oxidate ester, from about 30 to 40% of a calcium dinonylnaphthalene sulfonate, and from about 15 to 25% of a dibasic fatty acid.

22. The penetrating lubricant composition of claim 1, wherein said metal sulfonate comprises a mixture containing a calcium sulfonate and a zinc compound.

23. The penetrating lubricant composition of claim 1, wherein said copper deactivating compound is present in an amount in a range of from about 0.001 to 10.0 percent by weight of the total composition.

24. The penetrating lubricant composition of claim 1, wherein said copper deactivating compound is present in an amount in a range of from about 0.01 to 2.0 percent by weight of the total composition.

25. The penetrating lubricant composition of claim 1, wherein said copper deactivating compound is present in an amount in a range of from about 0.01 to 1.0 percent by weight of the total composition.

26. The penetrating lubricant composition of claim 1, wherein said copper deactivating compound is present in an amount in a range of from about 0.01 to 0.50 percent by weight of the total composition.

27. The penetrating lubricant composition of claim 1, wherein said copper deactivating compound is present in an amount of about 0.1 percent by weight of the total composition.

28. The penetrating lubricant composition of claim 1, comprises an alkylthiadiazole.

29. The penetrating lubricant composition of claim 1, comprises a zinc alkyldithiophosphate.

30. The penetrating lubricant composition of claim 1, comprises a 2,5-Dimercapto-1,3,4-thiadiazole derivative.

31. The penetrating lubricant composition of claim 1, wherein said copper deactivating compound is selected from the group consisting of a zinc alkyldithiophosphate, 2,5-Dimercapto-1,3,4-thiadiazole derivative, a benzotriazole, a benzotriazole derivative, a benzothiazole, a benzothiazole derivative, a triazole, a triazole derivative, a dithiocabamate, a dithiocarbamate derivative, an imidazole, an imidazole derivative, and combinations thereof.

32. The penetrating lubricant composition of claim 1, further comprising an odor masking agent present in an amount in a range of from about 0.001 to 1.0 percent by weight of the total composition.

33. The penetrating lubricant composition of claim 32, wherein said odor masking agent comprises a terpene.

34. The penetrating lubricant composition of claim 32, wherein said odor masking agent comprises vanilla.

35. The penetrating lubricant composition of claim 1, further comprising an odor masking agent present in an amount in a range of from about 0.1 to 1.0 percent by weight of the total composition.

36. The penetrating lubricant composition of claim 1, wherein said metal dithiophosphate is present in an amount in a range of from about 0.01 to 35.0 percent by weight of the total composition.

37. The penetrating lubricant composition of claim 1, wherein said metal dithiophosphate is present in an amount in a range of from about 0.1 to 5.0 percent by weight of the total composition.

38. The penetrating lubricant composition of claim 1, wherein said metal dithiophosphate is present in an amount in a range of from about 0.1 to 2.0 percent by weight of the total composition.

39. The penetrating lubricant composition of claim 1, wherein said metal dithiophosphate is a zinc dithiophosphate.

40. The penetrating lubricant composition of claim 1, wherein said metal dithiophosphate is a zinc alkyldithiophosphate.

41. The penetrating lubricant composition of claim 1, wherein said metal dithiophosphate comprises a zinc isopropyl methylamyl dithiophosphate, a zinc isopropyl isooctyl dithiophosphate, a barium di(nonyl)dithiophosphate, a zinc di(cyclohexyl)dithiophosphate, a copper di(isobutyl) dithiophosphate, a calcium di(hexyl)dithiophosphate, a zinc isobutyl isoamyl dithiophosphate, and a zinc isopropyl secondary-butyl dithiophosphate.

42. The penetrating lubricant composition of claim 1, wherein said long chain fatty acids are present in an amount in a range of from about 0.01 to 50.0 percent by weight of the total composition.

43. The penetrating lubricant composition of claim 1, wherein said long chain fatty acids are present in an amount in a range of from about 0.1 to 10.0 percent by weight of the total composition.

44. The penetrating lubricant composition of claim 1, wherein said long chain fatty acids are present in an amount in a range of from about 1 to 5 percent by weight of the total composition.

45. The penetrating lubricant composition of claim 1, wherein said long chain fatty acids comprise degras.

46. The penetrating lubricant composition of claim 1, wherein said long chain fatty acids further comprises esters which are the reaction product of fatty acids and naturally occurring alcohols.

47. The penetrating lubricant composition of claim 1, wherein said long chain fatty acids comprises a degras, a lanolin, a sperm oil, a beeswax, an ester wax, an ethyl lactate, a methyl laureate, a methyl oleate, an oleyl oleate, a methyl palmitate, a butyl ricinoleate, a methyl stearate, a propenyl stearate, a butyl ailed, a coconut oil, a lard oil, a palm oil, a babassu oil, a hydrogenated linseed oil, and combinations thereof.

48. A penetrating lubricant composition, comprising:

an oil comprising a Group I oil, a Group II oil, a Group III oil, a Group IV oil, a Group VI oil, a polyalkylglycol, a grease, a gel, an oil-soluble polymer composition, a mineral oil, a mineral oil and mineral spirits, a vegetable oil, a vegetable oil and an alcohol, a white mineral oil, a paraffinic oil, a MVI naphthenic oil, a synthetic oil, a synthetic and mineral oil blend, a synthetic and hydrogenated oil blend, a mineral oil and hydrogenated oil blend, and combinations thereof mineral oil present in an amount in a range of from 65 to 90 percent by weight of the total composition;

an oil soluble molybdenum lubricating compound present in an amount in a range of from 1 to 5 percent by weight of the total composition;

a metal sulfonate present in an amount in a range of from 10 20 percent by weight of the total composition;

a long chain fatty acids comprises a degras, a lanolin, a sperm oil, a beeswax, an ester wax, an ethyl lactate, a methyl laureate, a methyl oleate, an oleyl oleate, a methyl palmitate, a butyl ricinoleate, a methyl stearate, a propenyl stearate, a butyl ailed, a coconut oil, a lard oil, a palm oil, a babassu oil, a hydrogenated linseed oil, and combinations thereof present in an amount in a range of from 1 to 10 percent by weight of the total composition;

a zinc alkyldithiophosphate present in an amount in a range of from 0.01 to 2.0 percent by weight of the total composition; and a 2,5-dimercapto-1,3,4 thiadiazole derivative present in an amount in a range of from 0.005 to 0.3 percent by weight of the total composition.

49. The penetrating lubricant composition of claim 1, further includes an effective amount of a carrier comprising a pressurized liquid propellant.

50. The penetrating lubricant composition of claim 49, wherein said pressurized liquid propellant comprises a non-floronated propellant.

51. The penetrating lubricant composition of claim 49, wherein said pressurized liquid propellant comprises a liquid hydrocarbon propellant.

52. The penetrating lubricant composition of claim 51, wherein said liquid hydrocarbon propellant comprises a propane and isobutane blend.

53. The penetrating lubricant composition of claim 51, wherein said hydrocarbon propellant is selected from the group consisting of A-31, A-46, A-70, A-108 propane/isobutane blends or combinations thereof.

54. The penetrating lubricant composition of claim 51, wherein said pressurized liquid propellant comprises an effective amount of up to 25 percent by weight of the total composition.

55. The penetrating lubricant composition of claim 51, wherein said pressurized liquid propellant comprises an effective amount of from between 5 and 20 percent by weight of the total composition.

56. The penetrating lubricant composition of claim 48, further includes an effective amount of a carrier comprising a pressurized liquid propellant.

57. The penetrating lubricant composition of claim 56, wherein said pressurized liquid propellant comprises a non-floronated propellant.

58. The penetrating lubricant composition of claim 56, wherein said pressurized liquid propellant comprises a liquid hydrocarbon propellant.

59. The penetrating lubricant composition of claim 58, wherein said liquid hydrocarbon propellant comprises a propane and isobutane blend.

60. The penetrating lubricant composition of claim 58, wherein said hydrocarbon propellant is selected from the group consisting of A-31, A-46, A-70, A-108 propane/isobutane blends or combinations thereof.

61. The penetrating lubricant composition of claim 58, wherein said pressurized liquid propellant comprises an effective amount of up to 25 percent by weight of the total composition.

62. The penetrating lubricant composition of claim 58, wherein said pressurized liquid propellant comprises an effective amount of from between 5 and 20 percent by weight of the total composition.

* * * * *